US009376894B2

(12) United States Patent
Abicht et al.

(10) Patent No.: US 9,376,894 B2
(45) Date of Patent: Jun. 28, 2016

(54) CONTROL AND SUPPLY UNIT

(75) Inventors: Daniel Abicht, Magdeburg (DE); Reinhard Thies, Allershel (DE); Joachim Keese, Hannover (DE); Florian Tegt, Fassberg (DE)

(73) Assignee: OneSubsea IP UK Limited, London (GB)

( * ) Notice: Subject to any disclaimer, the term of this patent is extended or adjusted under 35 U.S.C. 154(b) by 1041 days.

(21) Appl. No.: 13/510,896

(22) PCT Filed: Nov. 19, 2009 (Under 37 CFR 1.47)

(86) PCT No.: PCT/EP2009/008249

§ 371 (c)(1), (2), (4) Date: Nov. 5, 2012

(87) PCT Pub. No.: WO2011/060802

PCT Pub. Date: May 26, 2011

(65) Prior Publication Data

US 2013/0319652 A1 Dec. 5, 2013

(51) Int. Cl.

| | |
|---|---|
| ***E21B 43/12*** | (2006.01) |
| ***E21B 33/035*** | (2006.01) |
| *E21B 41/00* | (2006.01) |

(52) U.S. Cl.

CPC ..... *E21B 43/12* (2013.01); *E21B 33/0355* (2013.01); *E21B 41/0007* (2013.01); *E21B 41/0085* (2013.01)

(58) Field of Classification Search

CPC ..... E21B 33/0355; E21B 41/0085

See application file for complete search history.

(56) References Cited

U.S. PATENT DOCUMENTS

| | | | | |
|---|---|---|---|---|
| 6,257,549 | B1 * | 7/2001 | Hopper | 251/129.11 |
| 6,420,976 | B1 * | 7/2002 | Baggs et al. | 340/853.3 |
| 6,595,487 | B2 * | 7/2003 | Johansen et al. | 251/129.04 |
| 6,998,724 | B2 * | 2/2006 | Johansen et al. | 290/1 R |
| 2004/0262008 | A1 * | 12/2004 | Deans et al. | 166/339 |
| 2005/0121188 | A1 | 6/2005 | Douglas et al. | |
| 2006/0214667 | A1 * | 9/2006 | Mizushima | 324/500 |

FOREIGN PATENT DOCUMENTS

| | | |
|---|---|---|
| EP | 0984133 A1 | 3/2000 |
| GB | 2364396 A | 1/2002 |
| WO | 98/41730 | 9/1998 |

OTHER PUBLICATIONS

International Application No. PCT/EP2009/008249 Search Report and Written Opinion dated Jul. 13, 2010.

* cited by examiner

*Primary Examiner* — Nicole Coy

(74) *Attorney, Agent, or Firm* — Conley Rose, P.C.

(57) ABSTRACT

A control and supply unit for an actuating device of a choke, a valve, a blow-up preventer or some other device applied in the field of oil and natural gas production includes at least an auxiliary power supply which is specially rechargeable, and a connecting means used for an exchange of data and/or for the purpose of voltage supply. To improve such a control and supply unit, such that the respective connecting means satisfy a relevant standard and has a compact structural design and is also easily accessible from outside, the control and supply unit includes, as a connecting means, a communication interface for connecting thereto a field bus and a voltage supply connection for connecting thereto a voltage supply line.

12 Claims, 1 Drawing Sheet

CONTROL AND SUPPLY UNIT

This application is the U.S. National Stage under 35 U.S.C. §371 of and claims priority to International Patent Application No. PCT/EP2009/008249 filed Nov. 19, 2009, entitled "Control and Supply Unit."

STATEMENT REGARDING FEDERALLY SPONSORED RESEARCH OR DEVELOPMENT

Not applicable.

BACKGROUND

The present disclosure relates to a control and supply unit for an actuating device of a choke, a valve, a blow-out preventer or some other device applied in the field of oil and natural gas production. Actuating devices and power supply devices of the type in question are described, for example, in PCT/EP2007/003307, PCT/EP2007/003308, PCT/EP2007/004793 or PCT/EP2003/09696.

SUMMARY

An embodiment of the control and supply unit comprises at least an auxiliary power supply, which is especially rechargeable, and a connecting means used for an exchange of data and/or for the purpose of voltage supply. Such application devices are arranged, e.g., on the seabed, where they may also constitute part of a so-called tree. In particular, in the case of electrically operated actuating devices for such application devices, a connecting means for connecting a voltage supply is required. In addition, the actuating device is normally controlled and monitored with the aid of a respective connecting means for an exchange of data. Data may be exchanged, e.g., with a unit, which is arranged above the sea level, through a cable connection. Also the voltage supply may be effected through such a cable connection or, like the exchange of data, from a subsea control module.

It is the object of the present disclosure to improve a control and supply unit of the type specified at the beginning in such a way that the respective connecting means satisfies a relevant standard and has a compact structural design and is also easily accessible from outside.

This object is achieved by the features of claim 1.

In particular, the control and supply unit comprises, as a connecting means, a communication interface for connecting thereto a field bus and a voltage supply connection for connecting thereto a voltage supply line.

According to the present disclosure, a connection to the actuating device can be established easily by means of the control and supply unit. This control and supply unit also satisfies relevant standards, such as the SIIS (Subsea Instrumentation Interface Standardisation); these standards especially refer to the connection of control systems to a respective sensor of the actuating devices.

The control and supply unit according to the present disclosure has a compact structural design and satisfies all the demands on an arrangement, especially a submarine arrangement, on the seabed or on a tree.

The respective actuating device is normally accommodated in a housing. The control and supply unit may be arranged in this housing as well. It may, however, be of advantage when the respective unit is implemented separately of the actuating device. This will make the unit more easily accessible, e.g., for the purpose of maintenance.

In this connection, it can also be regarded as advantageous when the unit comprises a unit housing which is releasably secured to the actuating device.

In order to satisfy level 2 of the SIIS regulation, the field bus may be a CAN bus. Such a bus is a standardized, real-time field bus for serial data transmission. Such a CAN bus is normally a two-wire bus and can be implemented with copper wires or through glass fibres.

Quite generally, it is also possible to transmit the respective data via the voltage supply line. According to the present disclosure, it is especially suggested that in some embodiments the connections for the field bus and the voltage supply line can be implemented as separate connections.

For redundancy reasons, in some embodiments, it will additionally be of advantage when the actuating device has associated therewith two control and supply units. These two units can be releasably secured to the actuating device, e.g., by means of their unit housing.

The unit housing may contain a plurality of components, sub-systems or means, and at least the communication interface, the auxiliary power supply and a motor control unit are arranged in the unit housing.

Respective connections of the auxiliary power supply and the motor control unit are extended from the control and supply unit towards the actuating device and are connected to said actuating device.

In some embodiments, in order to simplify the structural design of the control and supply unit in its entirety, the communication interface and the voltage supply connection can be defined by a supply and communication assembly. The latter can be arranged as a separate unit within the unit housing and it can be connected to the other assemblies within said unit housing, such as the auxiliary power supply, the motor control unit or the like.

In some embodiments, in order to simplify the respective connection between the supply and communication assembly and the other assemblies in the unit housing, the supply and communication assembly can comprise at least outputs for supplying electric power to the motor control unit, the auxiliary power supply, and/or at least one sensor unit of the actuating device.

In some embodiments, it is also possible that the supply and communication assembly comprises connections for communication with and/or control of the auxiliary power supply, the motor control unit and/or the sensor unit of the actuating device. The bus connections in question can be adapted to various types of buses, such as a CAN bus, an RS485 bus or the like. This applies analogously also to the outputs for supplying electric power, which can provide different voltages, depending on the voltage required for the respective assembly supplied.

Furthermore, in some embodiments, it can be considered to be of advantage when the supply and communication assembly is provided with a ground terminal connected at least to the auxiliary power supply and/or the motor control unit.

In addition, in some embodiments, it will be advantageous when an inert gas atmosphere is provided in the unit housing. This inert gas atmosphere may, for example, be a nitrogen atmosphere under a pressure of 1 to 2 or more than 2 bar.

In some embodiments, in order to allow a simple connection of the control and supply unit from outside, the unit housing can be provided with a plug connection device, which is accessible from outside, for the communication interface and the voltage supply connection. It is thus possible to establish by means of only one plug connection device a connection with the communication interface as well as with the voltage supply connection.

In this context, the connection in question can be a connection to a subsea control module for communication and/or voltage supply. It is, however, also possible to provide communication and a supply of voltage via separate connection lines to different control modules or to other control units, in particular to control units on the seabed.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
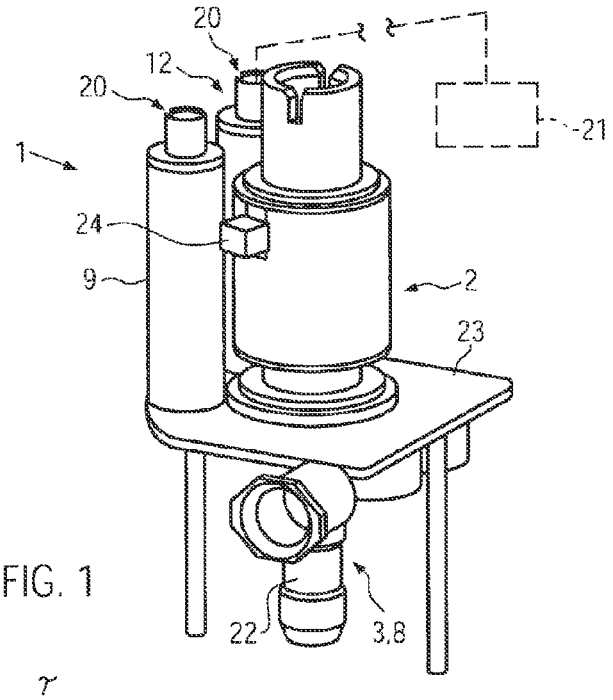
FIG. 1 shows a perspective view of an actuating device for a choke with the control and supply unit according to the present disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 shows a perspective side view of an actuating device 2 for a choke 3, which is only shown in the form of a choke insert 22, as an application device 8. The actuating device 2 comprises at least a spindle drive having a drive unit associated therewith, and in particular also a position sensor, all said components being arranged within a cylindrical housing. The choke insert 22 is longitudinally displaceable by means of the spindle drive.

Other devices applied in the field of oil and natural gas production are, e.g., a valve, a blow-out preventer or other units of this type. Directly adjacent the actuating device 2, a control and supply unit 1 according to the present disclosure is arranged on a base plate 23. In some embodiments, this control and supply unit 1 is of redundant design so that a second control and supply unit 12 is arranged directly adjacent said first unit and in parallel relationship therewith. The control and supply units 1 and 12, respectively, have a unit housing 9. Also this unit housing 9 is cylindrical and is provided with a plug connection device 20 on its upper end in FIG. 1. This plug connection device serves to connect a respective connection cable for transmitting data and for supplying electric power.

The broken line in FIG. 1 represents such a control module 21, which is also arranged below the sea level and, in particular, on the seabed.

In some embodiments, the whole unit shown in FIG. 1 can be transported, e.g., by an ROV (remote operated vehicle) and it can be conveyed to and removed from its usage site.

A terminal 24 is arranged laterally on the housing of the actuating device 2, said terminal being used for connecting thereto an electric connection line. This electric connection line is not shown in FIG. 1 and serves to supply power to one or a plurality of electric motors within the actuating device 2. These motors are associated with the spindle drive as a drive unit used for displacing said spindle drive. The electric connection line serves to establish a connection with the control and supply units 1 and 12, respectively.

Figure 2:
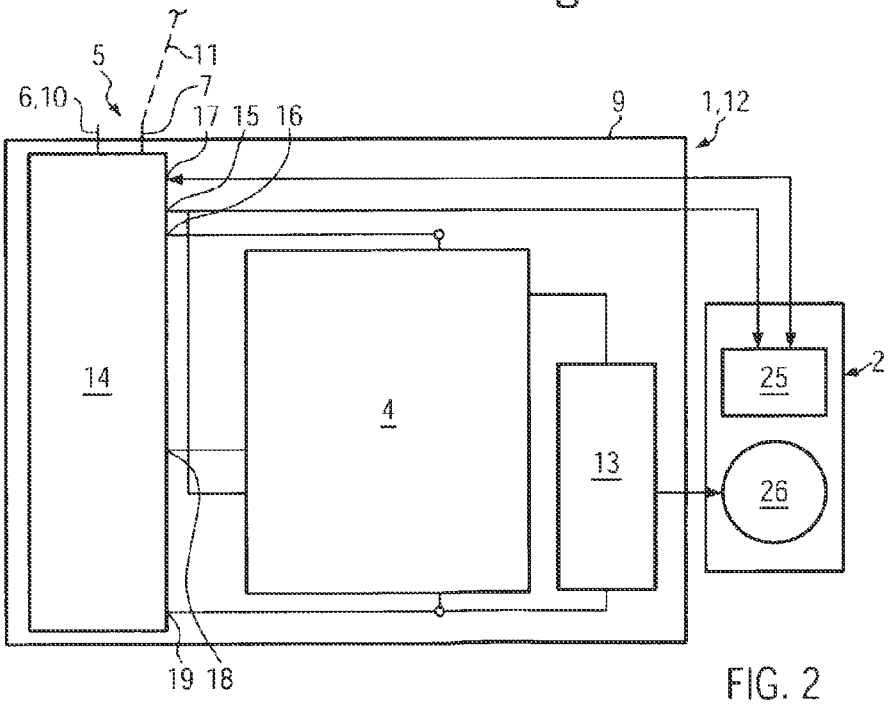
FIG. 2 shows a block diagram of the control and supply units and of the actuating device.

FIG. 2 shows a block diagram of the unit according to FIG. 1. Various assemblies are arranged within the respective unit housing 9 of the control and supply units 1 and 12. A first assembly is a supply and communication assembly 14. This supply and communication assembly 14 comprises the respective terminals and the connecting component, assembly, or means 5 contacted via the plug connection device 20 according to FIG. 1.

The connecting component, assembly, or means 5 comprises a communication interface 6 and a voltage supply connection 7. A voltage supply line 11, which is connected to the voltage supply connection 7, is shown at said voltage supply connection. This voltage supply line 11 extends, for example, up to the control module 21 as shown in FIG. 1.

The communication interface 6 is implemented as a field bus interface and, in some embodiments, is especially used for connecting a CAN bus thereto.

In some embodiments, the voltage supply connection 7 is, e.g., a d.c. voltage connection for a specific wattage, as for example 48W, and for a specific electric voltage or electric voltage range, as for example 20-27 VDC.

The supply and communication assembly 14 is provided with additional connections within the unit housing. These connection are, e.g., two terminals 15, 16 for supplying electric power to an auxiliary power supply 4 and a sensor unit 25 of the actuating device 2. The sensor unit 25 may also comprise different sensors, e.g., for position determination, temperature detection or the like.

In addition, the supply and communication assembly 14 is provided with bus connections 17 and 18 through which data are exchanged with the auxiliary power supply 4 or the sensor unit 25. Bus connection 17 is, e.g., an RS485 bus connection and bus connection 18 is a CAN bus connection, in some embodiments.

In some embodiments, via the bus connection 18 and through the auxiliary power supply 4, it is also possible to control the respective motor control unit 13. This motor control unit 13 is connected to respective motors, which are only shown schematically in FIG. 2 and which are identified by reference numeral 26.

The respective terminals 15 and 16 used for the purpose of electric supply can provide different wattages and voltages. In addition, the auxiliary power supply 4 can be connected to the supply terminal 16 of the supply and communication assembly 14 for the purpose of recharging and it can also be connected to the terminal 15, which is also associated with the sensor unit 25.

Finally, in some embodiments, the supply and communication assembly 14 is also provided with a ground terminal 19, which is connected to both the auxiliary power supply 4 and the motor control unit 13.

In some embodiments, within the unit housing 9, an inert gas atmosphere may prevail, e.g., a dry nitrogen atmosphere with a pressure of 1 to 2 or more than 2 bar.

The control and supply unit according to the present disclosure serves to supply the actuating device with data as well as with electric power. The respective terminals are standardized so as to satisfy in particular the demands specified in SIIS. Making use of the control and supply unit, the actuating device can be operated and controlled easily. The control and supply unit comprises all the assemblies which are required for controlling the actuating device as well as for supplying electric power thereto. The auxiliary power supply is rechargeable and is especially used for compensating power shortages or shortfalls. Sufficient power is provided for the idling state of the respective motors of the actuating device as well as for operating said motors when they are in operation.

In some embodiments, the control and supply unit 1 is mounted together with the actuating device 2 and can easily be transported together therewith, i.e., the whole unit shown in FIG. 1 can be transported, e.g., by an ROV and retrieved for the purpose of maintenance or repair.

What is claimed is:

1. A control and supply unit for an actuating device of a choke, a valve, a blow-out preventer or another device applied in the field of oil and natural gas production, said unit comprising:

a unit housing releasably secured to the actuating device and comprising:

a plug connection device configured to exchange of data and to supply a received voltage;

a motor control unit inside the unit housing; and an auxiliary power supply inside the unit housing;

a supply and communication assembly as a separate unit inside the unit housing, the separate supply and communication assembly comprising:

a plurality of terminals configured to be contacted via the plug connection device and configured to:

exchange data through a communication interface comprising a field bus; and supply voltage to a voltage supply connection; and a plurality of terminals internal to the unit housing and configured to:

exchange data between the communication interface and the auxiliary power supply; and receive voltage from the voltage supply connection and supply said voltage to the auxiliary power supply.

2. The control and supply unit of claim 1, wherein the unit is implemented separately of the actuating device.

3. The control and supply unit of claim 1 wherein the field bus is a CAN bus.

4. The control and supply unit of claim 1, wherein the field bus and the voltage supply line couplings are implemented as separate connections.

5. The control and supply unit of claim 1 further comprising a second control and supply unit coupled to the actuating device for redundancy.

6. The control and supply unit of claim 1 wherein the supply and communication assembly comprises at least connections for supplying electric power to the motor control unit and/or at least one sensor unit of the actuating device.

7. The control and supply unit of claim 1 wherein the supply and communication assembly comprises bus connections for communication with and/or control of the motor control unit and/or at least one sensor unit of the actuating device.

8. The control and supply unit of claim 1 wherein the supply and communication assembly is provided with a ground terminal connected at least to the auxiliary power supply and/or the motor control unit.

9. The control and supply unit of claim 1 wherein an inert gas atmosphere is provided in the unit housing.

10. The control and supply unit of claim 1 wherein the plug connection device is accessible from outside, for the communication interface and the voltage supply connection.

11. The control and supply unit of claim 1 wherein the unit is connected to a submarine control module for communication and/or voltage supply.

12. The control and supply unit of claim 1 wherein the auxiliary power supply is rechargeable.

* * * * *